US007056268B2

(12) United States Patent
Emick

(10) Patent No.: US 7,056,268 B2
(45) Date of Patent: Jun. 6, 2006

(54) FREE WEIGHT LIFTING BAR WITH ADJUSTABLE HANDLES

(76) Inventor: Daniel W. Emick, 4882 Rte. 87 Highway, Williamsport, PA (US) 17701

( * ) Notice: Subject to any disclaimer, the term of this patent is extended or adjusted under 35 U.S.C. 154(b) by 391 days.

(21) Appl. No.: 10/448,150

(22) Filed: May 29, 2003

(65) Prior Publication Data

US 2004/0242385 A1 Dec. 2, 2004

(51) Int. Cl.
*A63B 21/75* (2006.01)

(52) U.S. Cl. ..... 482/106; 482/139

(58) Field of Classification Search ..... 482/106–108, 482/97–103, 135–138, 139; D21/680–682
See application file for complete search history.

(56) References Cited

U.S. PATENT DOCUMENTS 4,629,184 A * 12/1986 Selkee ..... 482/106
4,717,147 A 1/1988 Rochelle
4,872,667 A * 10/1989 Favot ..... 482/106
4,974,837 A 12/1990 Someya et al.
5,152,731 A * 10/1992 Troutman ..... 482/106
5,284,458 A 2/1994 Perry et al.
5,295,933 A * 3/1994 Ciminski et al. ..... 482/107
5,827,157 A 10/1998 Lee
5,971,902 A 10/1999 Robertson et al.
D416,959 S 11/1999 Tumminia
6,196,950 B1 3/2001 Emick
6,663,542 B1 * 12/2003 Trabbic ..... 482/106

* cited by examiner

*Primary Examiner*—Stephen K. Cronin
*Assistant Examiner*—Fenn C. Mathew
(74) *Attorney, Agent, or Firm*—Thomas R Shaffer

(57) ABSTRACT

A free weight lifting bar includes a central bar member having opposite ends. A pair of a drop down plates, each having a top end and a bottom end, are attached at the top end thereof to opposite ends of the central bar member. A pair of handle members are adjustably attached to said central bar. A pair of weight bars are provided. One of the weight bars is attached to and extends outwardly from the bottom end of each of the pair of drop down plates. The weight bars are adapted to receive and secure a desired number of free weight. A pair of weight bar clamps are used to secure the free weights onto said weight bars.

12 Claims, 4 Drawing Sheets

FREE WEIGHT LIFTING BAR WITH ADJUSTABLE HANDLES

BACKGROUND OF THE INVENTION

1. Field of the Invention

A free weight lifting bar with adjustable handles is disclosed. More specifically, a lifting bar is provided with a pair of handles which may be adjusted to allow a user to perform a variety of lifting exercises in an ergonomically correct manner.

2. Prior Art

The present invention is useful in performing a variety of exercises. It is particularly useful in the performance of three exercises will be discussed separately making reference in each instance to the prior art devices currently known for the performance of such exercises.

The first exercise is known as the "Close Grip Barbell Triceps Press Exercise" which is a popular free weight exercise movement used to strengthen and develop the triceps muscles located in the posterior upper arm. To perform this movement, the exerciser begins by lying prone and face up on a barbell pressing bench with a shoulder width and thumbless grip. With elbows rotated in towards the body and bar resting on palms, the exerciser presses upward, straightening the arms and clearing the barbell from the rack. The bar is then lowered towards the chest by bending and lowering the elbows until the upper arms are parallel to the body. The exerciser then reverses the direction of the bar, pressing upward until the arms are straight again, and then lowers and repeats to complete the set. The forearms remain vertical at all times throughout the close grip barbell triceps press exercise movement.

The traditional equipment utilized for performance of the close grip barbell triceps press exercise consists of a barbell and barbell pressing bench. This traditional method of triceps development, although effective, places the exerciser at risk of fatigue induced impact injuries due to loss of barbell control and slippage from the thumbless, palm style grip which is necessary for maximum exercise efficiency. Additionally, the bar's across body transverse orientation and exercise dynamics, dictate an unnatural wrist rotation that places excessive amounts of rotational torque on wrist, elbow and shoulder joints. Such wrist rotation can lead to muscle, joint and connective tissue injuries in the affected areas. Furthermore, unless the exerciser has the ability to keep the elbows rotated in towards the body throughout the full range of vertical motion inherent to said exercise, the exercise's effectiveness at targeting the triceps is severely diminished.

Other than the present invention, there are no other free weight triceps pressing aids or devices designed specifically for this exercise other than the traditional use of the barbell and the barbell bench pressing apparatus.

The present invention, greatly reduces the risks inherent with the traditional close grip barbell triceps press while effectively capturing its benefits. Safety is ensured due to the exerciser's ability to use a thumb wrapped grip on the device of the present invention thereby reducing impact injuries caused by the dropping of weight from the thumbless, palm style grip used on the barbell triceps press exercise. Additionally, the device of the present invention provides a rotationally adjustable vertical grip (in line with body), which affords users a means of achieving the optimal hand position necessary to effectively target all three heads of the triceps muscle group. Furthermore, the rotationally adjustable vertical grip also negates negative joint torque issues common to the close grip barbell triceps press exercise when a transverse across the body barbell position is utilized. In addition, present invention provides horizontally adjustable grip spacing and thus allows users of any shoulder width the ability to achieve the ideal grip width necessary to assure that the elbows remain close to the body throughout the triceps press movement's range of motion thereby making the movement optimally effective.

The present invention may be used in combination with a vertically adjustable gravity fed locking rack system which ensures optimal elevation settings for the exerciser's limb length and a secure platform from which to load and unload the otherwise cumbersome, weight loaded lift bar apparatus. The racking system also affords the spotter (exerciser's assistant) an elevated platform from which to safely "spot" the exerciser should said exerciser require assistance to safely rack the unit on the lock down rack when fatigue sets in.

The second exercise is known as the "Hammer Grip Overhead Dumbbell Shoulder Press Exercise. It is a free weight, multiplane, shoulder pressing exercise performed with dumbbells and the exerciser may be positioned in either a seated or standing position. To execute this exercise, the exerciser grasps the dumbbells as one would grasp a hammer with the palms facing in towards the body. The dumbbells are then jerked to shoulder level from either a seated or a squat into an erect standing position. The exerciser then presses the dumbbells overhead to a full extension of the arms. The prime movers for this pressing movement are the anterior deltoids and to a lesser degree, the total shoulder muscles in addition to the pectoralis and triceps muscle groups. This exercise, performed standing, is often used as a means of measuring and developing total body functional strength as it forces core stabilizers (abdominals, serratus, obliques, erector muscles, etc.) and muscles of the legs into a movement support role.

The equipment traditionally used for performance of the hammer grip overhead dumbbell shoulder press exercise consists of dumbbells as means of adding the resistance necessary to induce an adaptive training response. The use of dumbbells for adding resistance has significant drawbacks. First, there is the problem of getting the dumbbells into a pressing position at chest level just prior to performing the overhead press. Exercisers are forced to jerk the dumbbells from the floor, bench or, as is the case with the seated version, from the knees to the chest. Risks in the form of muscle pulls, connective tissue damage, joint trauma or impact injury to the body via loss of control or poor movement form are obvious, especially in light of the high amounts of dumbbell weight exercisers can attain due to the "total body" force utilization inherent to this exercise. Another drawback to the use of dumbbells for this overhead press exercise is the difficulty of getting the dumbbells from ones shoulders to the safety of the floor or dumbbell rack when the set is complete. The aforementioned risks are once again encountered and often compounded due to the fatigued state of the exerciser at the completion of the repetition set. Additionally, since there are no two handed resistance devices which can be used to perform this movement, exercisers must use dumbbells which limit maximum force production and optimal development of the muscles involved due to safety and control factors common to dumbbell usage.

Again, other than the present invention, no other free weight hammer grip overhead shoulder pressing apparatus exists which can facilitate said exercise movement.

The present invention, reduces the risks associated with the dumbbell version of the hammer grip overhead shoulder press exercise while allowing for maximum force production and muscular development of the affected muscle groups. The first risk reduced by with the use of the racking system is that of dumbbell loading. The racking allows exercisers to easily adjust the lift bar of the present invention to a desired vertical height to achieve a chest level pressing position. The lift bar may then be safely loaded with the weight secured by the novel gravity lock down system. Once loaded, the user may safely open the gravity lock down, freeing the lift bar to commence the pressing movement.

The second risk associated with the dumbbell overhead shoulder press is that of the unloading of the dumbbells at shoulder level upon completion of repetition set. The rack system also eliminates the unsafe unloading process by providing the chest level gravity lock down rack on which to secure the lift bar upon completion of set. One may then safely unload the weight from the locked down lift bar when finished.

The lift bar itself also reduces safety and control issues common to dumbbell usage by allowing for two handed control and thereby providing maximal safe force production.

The third exercise is known as the "Reverse Grip Bent Over Barbell Row Exercise" which is a free weight exercise performed to target and strengthen primarily the latissimus dorsi muscles of the upper back. To execute the movement, the exerciser first grips a barbell from the floor or a rack with a shoulder width, reverse, underhand grip (palms facing away from the body). The exerciser then picks up the bar from the floor or rack, (rack typically holding bar at mid thigh level) steps rearward and assumes a slightly wider then shoulder width foot stance. With arms extended downward to bar, head up, chest out and back slightly arched, the exerciser bends at the waist until the torso reaches an approximately 40 degrees angle. Once in this position, the exerciser begins the reverse grip bent over barbell rowing exercise by pulling the elbows and barbell upward towards abdomen while holding the body in a fixed position. Once a full upward range of motion is achieved (bar touching abdomen), the exerciser lowers the bar and elbows until the arms are fully extended and repeats to the completion of a set of repetitions.

The equipment traditional used for performance of the free weight reverse grip bent over barbell row exercise consists of a standard barbell and barbell rack. The primary limiting factor in the effectiveness of this exercise for maximal contraction of the latissimus dorsi muscle group is a result of the bar to body positioning relationship. The transverse across body bar positioning grants users two gripping options. Option one which is an overhand grip, diverts resistance upward and away from latissimus dorsi muscles and does not allow for maximal vertical range of motion. Option two which is an underhand palms away grip, allows for maximal vertical range of motion. Option two (underhand palms away grip) allows for maximal range of motion, but unfortunately limits maximum latissimus dorsi contraction which can only be achieved by utilizing a palms facing each other gripping configuration. Existing art provides a number of complete machine versions of this gripping configuration but no "free weight" apparatus has been designed to accommodate this exercise movement. Thus, other than the present invention, no free weight, plate loaded apparatus designed specifically to target the latissimus dorsi muscles of the upper back is known to exist.

The present invention, solves the primary limiting factor in the effectiveness of the reverse grip bent over barbell row exercise by virtue of it's rotationally adjustable vertical grip configuration which places the hands in the ideal position (palms facing each other) to effectively target the latissimus dorsi muscles of the upper back. The racking system also provides for a safe and rapidly adjustable platform from which to execute this exercise movement. Furthermore, the present invention's horizontally adjustable handles accommodate all user shoulder widths to greater enhance exercise effectiveness.

Thus, there remains a need for a free weight lifting bar device which addresses the limitations set forth above.

SUMMARY OF THE INVENTION

A free weight lifting bar is disclosed which, in its simplest form, comprises a central bar member having opposite ends; a pair of a drop down plates each having a top end and a bottom end, one of said pair of drop down plates attached at said top end thereof to each of said opposite ends; a pair of handle members attached to said central bar; a pair of weight bars, one of said pair of weight bars attached to and extending outwardly from the bottom end of one of said pair of drop down plates, said weight bars adapted to receive and secure a desired number of free weights; and a pair of weight bar clamps to secure said desired number of free weights onto said weight bars.

Preferably, said central bar member has at least one hole at each of said opposite ends thereof and may have a plurality of holes at each of said opposite ends thereof.

While said central bar member may comprise a single member, alternatively the central bar may further comprises a center portion and a pair of end portions attached to said central portion. In this embodiment said end portions may be adjustable attached to said central portion allowing the overall length of the central bar to be adjusted.

Preferably, said pair of handle members are adjustably attached to said central bar and said pair of handle members each include a tube portion. The tube portion is adapted to be received by and slide on said opposite ends of said central bar whereby each of said handle members can be adjusted to and secured to a desired position on said central bar member. Each tube portion preferably includes a popper member adapted to be received by a hole in said central bar portion.

Preferably, said pair of handle members each include a grip bar portion wherein a center point of each said grip bar portion is provided in a co-linear relationship with said pair of weight bars.

Preferably, each handle member further comprises a tube portion and a grip bar portion with said grip bar portion being attached to said tube portion in a perpendicular orientation relative to said tube portion. Said grip bar portion is also preferably attached to said tube portion in a perpendicular orientation relative to said weight bar. In an alternate embodiment of the invention, said grip bar portion is rotatably adjustable relative to said tube portion and may be fixed in any one of a number of desired rotational positions.

Preferably, said pair of weight bars are provided in a co-linear relationship with each other. Also, it is preferred that said pair of weight bars are provided in a co-linear relationship with respect to each other and with respect to a center point on said grip bar portions of said handle members.

Preferably, said pair of weight bar clamps each further comprise an annular ring member and a screw member and said screw member includes a screw handle.

DETAILED DESCRIPTION OF THE PREFERRED EMBODIMENTS

Figure 2:
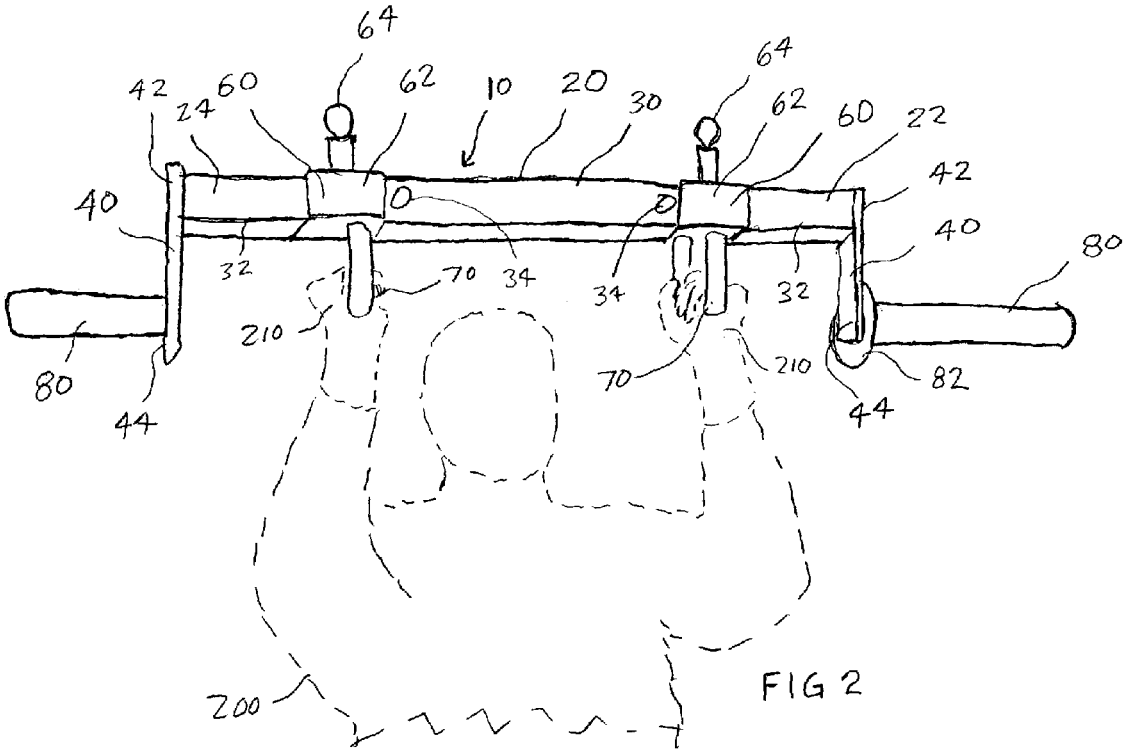
FIG. 2 is a perspective view of the free weight lifting bar of the present invention as in use in the overhead shoulder press exercise.

Referring specifically to FIGS. 1–4, the free weight lifting bar 10 of the present invention includes a central bar member 20 which has opposite end portions 22 and 24, respectively. The central bar member 20 has a plurality of holes 25 therein at opposite ends 22 and 24 of the central bar member 20. Holes 25 cooperate with popper 64 of handle members 62 allow said handle members to be adjustable in width. The central bar member 20 may be formed as a single piece or component or may comprise multiple pieces.

As shown, the central bar member 20 comprises a center portion 30 into which a pair of end portions 32 are inserted. The end portions 32 are telescopically inserted into the center portion 30 and are then fixed at a desired overall length by a pair of bolts 34. It will be obvious that with such an arrangement, the overall length of the free weight lifting bar could be made longer or shorter by simply connecting the end portions 32 at different locations within the center portion 30.

The free weight lifting bar 10 also includes a pair of drop down plates 40 which each have a top end 42 and a bottom end 44. The top end 42 of each drop down plate 40 is attached to one of the opposite ends 22 and 24 of the central bar member 20.

A pair of handle members 60 are attached to the central bar member 20. As shown, the handle members 60 include a tube portion 62 which is adapted to slide over the central bar 20. The handle portion 60 may be secured in any desired location by use of the popper 64 which is adapted to be received in any desired hole 25. With this arrangement, the handle members can be adjusted to the width of the shoulders of a particular user quickly and efficiently. The handle members 60 also include a grip bar portion 70 which are adapted to be grasped by the hands 210 of a user 200.

Figure 1:
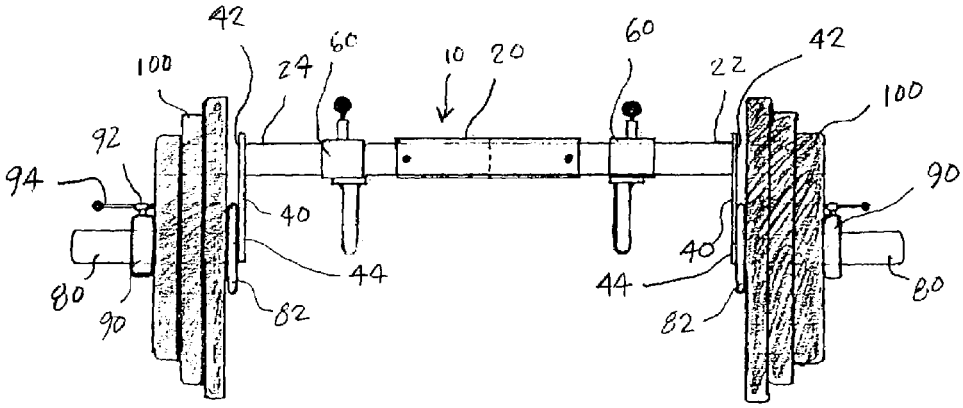
FIG. 1 is a side elevational view of the free weight lifting bar of the present invention.

The free weight lifting bar 10 also includes a pair of weight bars 80 which are attached to the lower end 42 of each drop down plate 40. Preferably, a weight bearing plate 82 is provided on an inner end of weight bar 80 adjacent to the lower end 44 of the drop down plate 40. The weight bars 80 are adapted to receive and secure a desired number of free weights 100 as shown in FIG. 1.

A pair of bar clamps 90 in the form of an annular ring member with a screw member 92 are provided. Preferably, the screw member 92 is provided with a screw handle 94 to tighten the bar clamp 90 onto the weight bar 80. The bar clamps 90 secure the free weights 100 on the weight bars 80.

Now that the basic components of the free weight lifting bar of the present invention have been identified, further details regarding these components and their relationships to one another will be addressed. Perhaps most importantly, the grip bar portion 70 of the handle members 60 is provided in a perpendicular orientation relative to the tube portion 62 of handle members 60. As is apparent from the drawings, the tube portions 62 are co-linear with the central bar member 20. Thus, the grip bar portion 70 is provided in an orientation which is preferably rotated 90° from the position which would otherwise occur with a standard barbell. While the grip bar portion may be fixed in such a perpendicular orientation relative to the tube portion 62, the grip bar portion 70 may also be attached to the tube portion 62 in a rotatably adjustable manner thereby allowing the grip bar portion 70 to be oriented with any desired angle with respect to the tube portion 62.

For example, it may be that a particular user might have a physical limitation with their arm or wrist which would make a perpendicular orientation of the grip bar portion 70 a less than ideal orientation. In such instances, by making the grip bar portion 70 rotatably adjustable to any desired angle relative to the tube portion 62, compensation for such a limitation could be effectively addressed.

Another aspect of the present invention is that it is preferred that the weight bars 80 be provided in a co-linear relationship with each other and also in a co-linear relationship with respect to a center point on the grip bar portions 70 of the handle members 60. The reason for this orientation is to provide the grip bar portions 70 where the user grips his hands 210 at essentially the center of gravity of the free weight plates 100 which are placed on the weight bars 80. This allows the weight bar lifting apparatus to not only provide the proper ergonomic orientation for the grip but also allows the grip to be positioned at the approximate center of gravity of the free weight plates 100.

Referring specifically to FIG. 2, it can be seen that the handle members 60 are adjusted to the proper location directly above the shoulders of the user 200. In this Figure, the user 200 grabs the grip bar portion 70 of the handle members and is shown performing the hammer grip overhead dumbbell shoulder press exercise.

Figure 3:
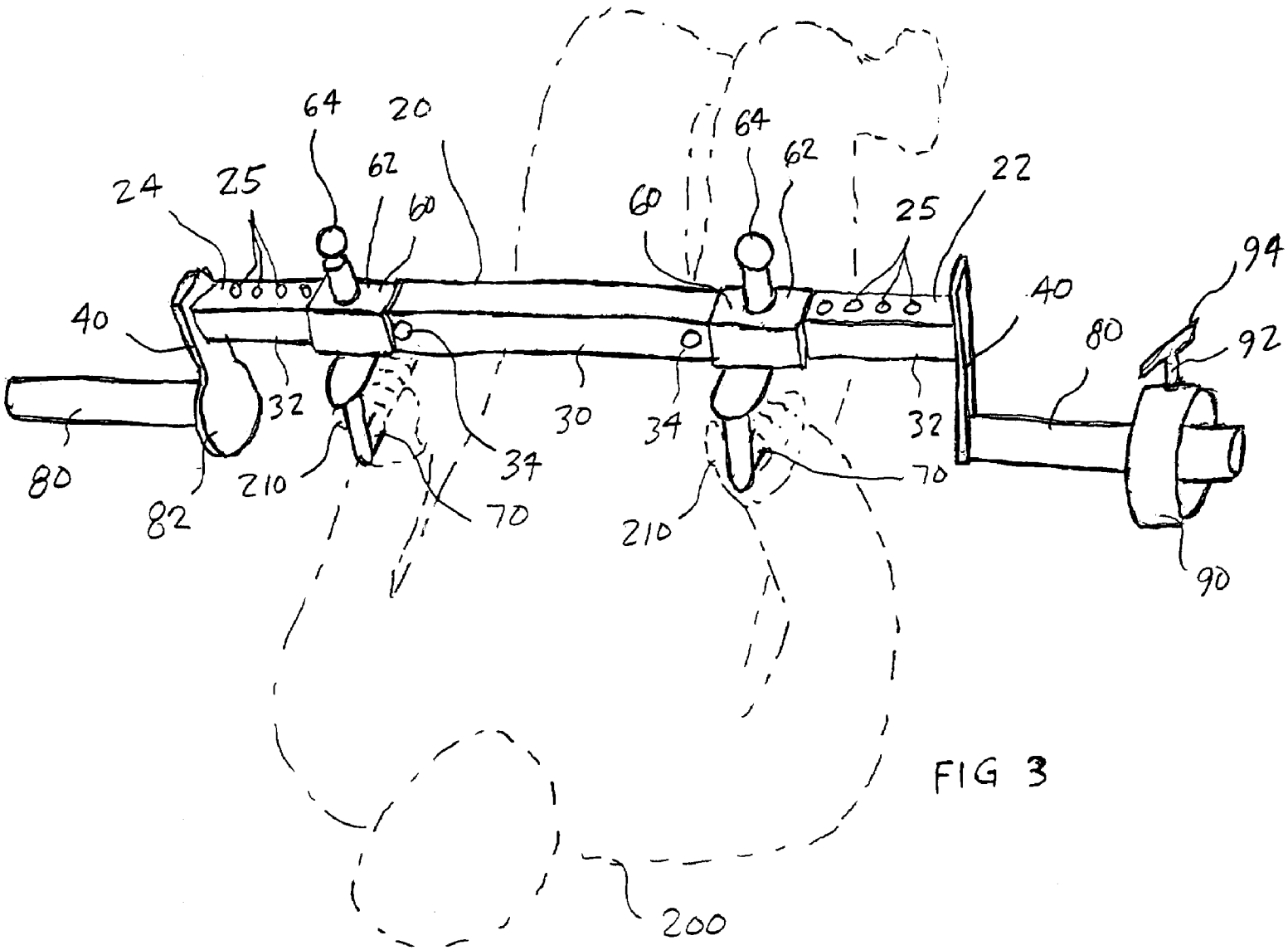
FIG. 3 is a perspective view of the free weight lifting bar of the present invention as in use in a close grip triceps press exercise.
Figure 4:
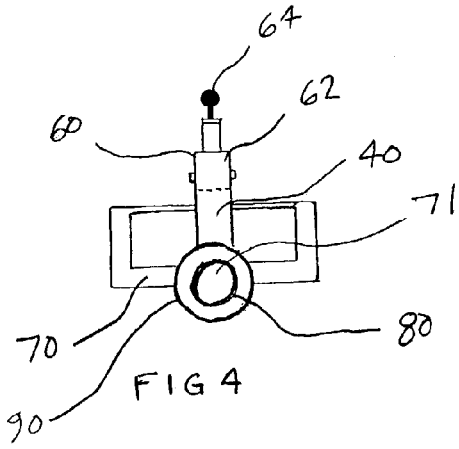
FIG. 4 is an end elevational view of the free weight lifting bar of the present invention.

Similarly, referring to FIG. 3, the handle members 60 are again adjusted to a proper width to match the width of the shoulders of user 200. In FIG. 3, user 200 grasps the grip bar portion 70 of the handle members 60 and is shown performing the close grip barbell triceps press exercise.

Figure 5:
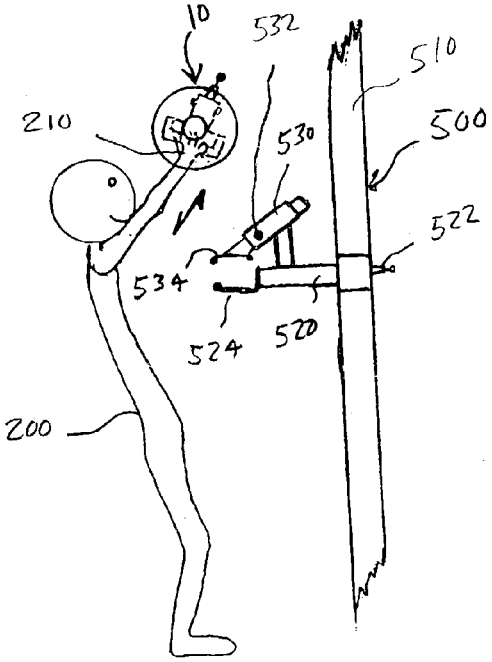
FIG. 5 is a side view of the free weight lifting bar of the present invention as in use in the overhead shoulder press and of the chest level gravity lock down rack.
Figure 6:
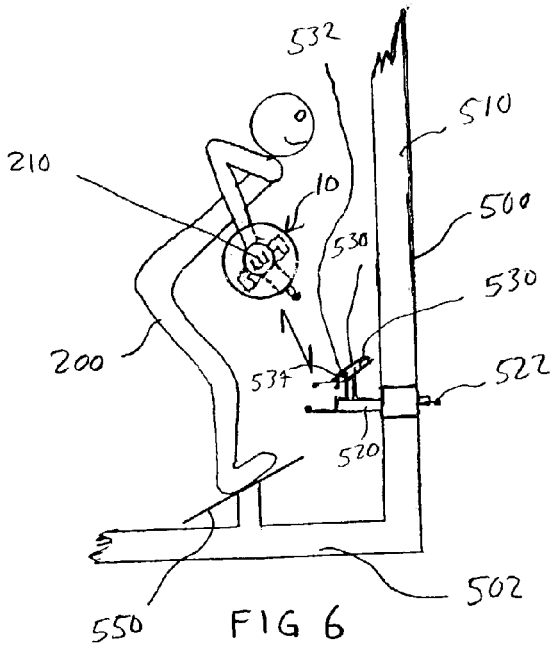
FIG. 6 is a side view of the free weight lifting bar of the present invention as in use in the bent over row exercise with the user standing on an inclined surface of the racking system.
Figure 7:
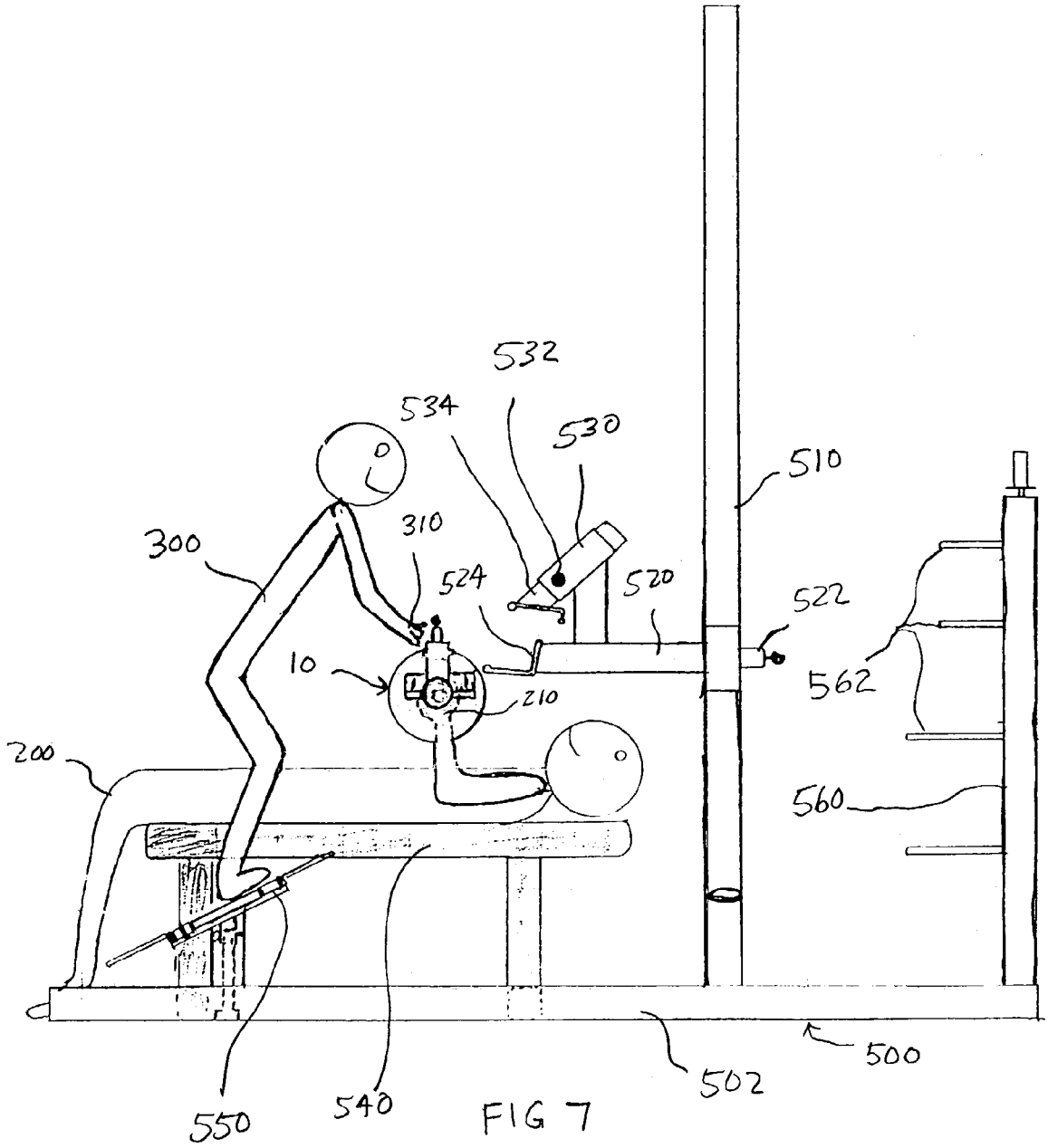
FIG. 7 is a side view of the free weight lifting bar of the present invention as used in the close grip triceps press by a user on a bench of the racking system with a spotter on a flip down spotter's stand.

Now referring to FIGS. 5, 6 and 7, the three exercises for which the free weight lifting bar of the present invention is specifically designed are shown being performed in combination with a gravity drop lock down racking stand 500. In each of these cases, the racking stand 500 includes a base 502, a vertical upright member 510 and a horizontal member 520 which may be adjusted vertically on the upright member 510. The horizontal arm member 520 is secured in a desired vertical position by popper 522. At the end of horizontal arm member 520 is a lower clamp member 524 shaped and configured to receive the central bar member 20 of the present invention. An inclined angled member 530 is provided which includes a telescoping upper clamp member 534. The upper clamp 534 slides down by the force of gravity when popper pin 532 is released. Thus, when the central bar member 20 is placed on the lower clamp member 524, the user simply pulls out the pin 532 and the upper bar clamp 534 falls upon the top of the central bar 40 holding it in place. The popper pin 532 is released to secure the bar member 20 in a proper position.

In FIG. 5, such a racking system 500 is shown in use for an overhead shoulder press. The racking system includes a flip down stand 550 which provides an inclined surface for the user 200 to stand upon is used for the bent over row exercise. Finally, in FIG. 7, the racking system 500 is shown to also include a bench 540 on which the user 200 reclines to perform the close grip triceps press. In this figure, a spotter 300 is also shown with his hands 310 in a position to assist user 200 should such assistance be required. As shown, spotter 300 stands upon the inclined surface of the flip down stand 550. FIG. 7 also shows the provision of a weight plate holder which includes a vertical member 560 and horizontal members 562 to receive the various weight plates 100.

The present invention having been disclosed in connection with the foregoing variations and examples, additional variations will now be apparent to persons skilled in the art. The invention is not intended to be limited to the variations specifically mentioned and accordingly reference should be made to the appended claims rather than the foregoing discussion of preferred examples to assess the scope of the invention in which exclusive rights are claimed.

I claim:

1. A free weight lifting bar comprising:

a central bar member having opposite ends;

a pair of a drop down plates each having a top end and a bottom end, one of said pair of drop down plates attached at said top end thereof to each of said opposite ends;

a pair of handle members attached to said central bar, said pair of handle members each including a tube portion, said tube portion adapted to be received by and slide on said opposite ends of said central bar whereby each of said handle members can be adjusted to and secured to a desired position on said central bar member, each handle member further comprising a grip bar portion adapted to be grasped by the hands of a user, said grip bar portion attached to a fixed position during use in a generally perpendicular orientation relative to said central bar;

a pair of weight bars, one of said pair of weight bars attached to and extending outwardly from the bottom end of each of said pair of drop down plates, said weight bars adapted to receive and secure a desired number of free weights; and a pair of weight bar clamps to secure said desired number of free weights onto said weight bars.

2. A free weight lifting bar according to claim 1 wherein said central bar member has at least one hole at each of said opposite ends thereof.

3. A free weight lifting bar according to claim 1 wherein said central bar member has a plurality of holes at each of said opposite ends thereof.

4. A free weight lifting bar according to claim 1 wherein said central bar member further comprises a center portion and a pair of end portions attached to said central portion.

5. A free weight lifting bar according to claim 4 wherein said end portions are adjustably attached to said central portion allowing the overall length of the central bar to be adjusted.

6. A free weight lifting bar according to claim 7 wherein each tube portion includes a popper member adapted to be received by a hole in said central bar portion.

7. A free weight lifting bar according to claim 1 wherein a center point of each said grip bar portion is provided in a co-linear relationship with said pair of weight bars.

8. A free weight lifting bar according to claim 1 wherein said grip bar portion being rotatably adjustable relative to said central bar member and being fixed during use in any one of a number of desired rotational positions to compensate for any limitation in an arm or wrist of a user.

9. A free weight lifting bar according to claim 1 wherein said pair of weight bars are provided in a co-linear relationship with each other.

10. A free weight lifting bar according to claim 1 wherein said pair of weight bars are provided in a co-linear relationship with respect to each other and with respect to a center point on said grip bar portions.

11. A free weight lifting bar according to claim 1 wherein said pair of weight bar clamps each further comprise an annular ring member and a screw member.

12. A free weight lifting bar according to claim 11 wherein said screw member includes a screw handle.

* * * * *